US005682681A

United States Patent [19]

Cincotta et al.

[11] Patent Number: 5,682,681

[45] Date of Patent: Nov. 4, 1997

[54] FIBER DRUM CHIME REMOVING SYSTEM

[75] Inventors: Bruce A. Cincotta, Wauwatosa; Charles J. Patrick, Milwaukee; Gary C. Zaiser, Nashotah, all of Wis.

[73] Assignee: Hydro-Thermal Corporation, Waukesha, Wis.

[21] Appl. No.: 431,913

[22] Filed: Apr. 28, 1995

[51] Int. Cl.[6] ..... B67B 7/72; B67B 7/78

[52] U.S. Cl. ..... 30/403; 30/413; 30/418; 30/434; 29/426.4; 82/92

[58] Field of Search ..... 30/400, 401, 403, 30/405, 406, 410, 412, 413, 415, 416, 417, 418, 420, 424, 425, 426, 427, 430, 433, 434, 436; 82/84, 92, 101; 29/426.2, 426.3, 426.5, 426.4

[56] References Cited

U.S. PATENT DOCUMENTS

| | | | |
|---|---|---|---|
| 1,006,574 | 10/1911 | Lorenz | 82/101 X |
| 2,461,015 | 2/1949 | Withrow | 30/415 X |
| 2,886,887 | 5/1959 | Krist et al. | 30/425 X |
| 3,161,952 | 12/1964 | Czapiewski | 30/425 X |
| 3,473,499 | 10/1969 | Bishop | 29/426.4 X |
| 3,510,932 | 5/1970 | Lammers et al. | 29/426.2 X |
| 3,878,604 | 4/1975 | Smith | 30/410 X |
| 3,898,898 | 8/1975 | Peres | 30/406 X |
| 4,072,072 | 2/1978 | Harb | 82/101 X |
| 5,137,206 | 8/1992 | Hale | 229/5.5 |
| 5,189,778 | 3/1993 | Shepard et al. | 29/426.4 |
| 5,232,117 | 8/1993 | Hale | 220/404 |
| 5,258,086 | 11/1993 | Hale | 156/190 |
| 5,273,181 | 12/1993 | Gay | 220/601 |
| 5,320,243 | 6/1994 | Hale | 220/404 |

*Primary Examiner*—Rinaldi I. Rada
*Assistant Examiner*—Boyer Ashley
*Attorney, Agent, or Firm*—Andrus, Sceales, Starke & Sawall

[57] ABSTRACT

A fiber drum chime removing system for disassembling fiber or paperboard drums having metal chimes has a stationary cutting assembly and a movable cutting assembly. The stationary cutting assembly cuts the upper edge of the fiber sidewall of the drum to remove the upper drum chime from the drum. Contemporaneously, the movable cutting assembly cuts the lower edge of the fiber sidewall of the drum. A chime cutter mounted to the movable cutting assembly then cuts the lower drum chime to remove from the drum. Air cylinders automatically engage the stationary and movable cutting assemblies, and electric DC motors automatically drive the cutting assemblies. The chime cutter is automatically actuated by an air cylinder. The position of the movable cutting assembly is also adjusted automatically with an air cylinder so that the movable cutting assembly can be located in the proper position for cutting engagement.

20 Claims, 8 Drawing Sheets

10
70
68
66
110
4
106
52
62
58
64
76
112
42
50
34
56
90
60
36
38
32
12
40

FIG. 13
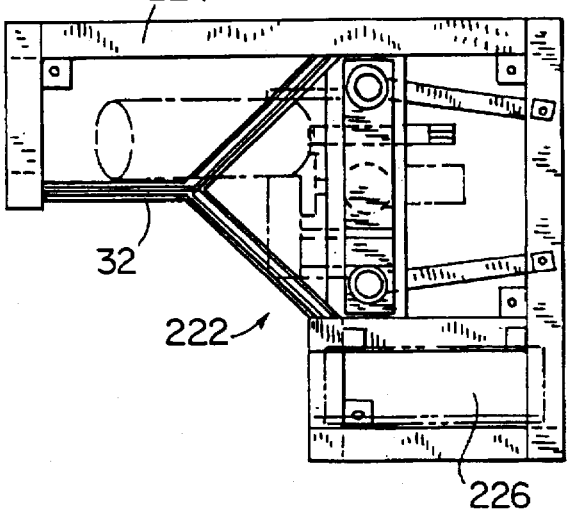
FIG. 11
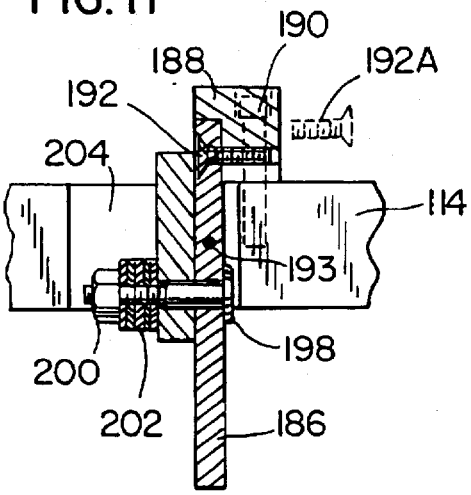
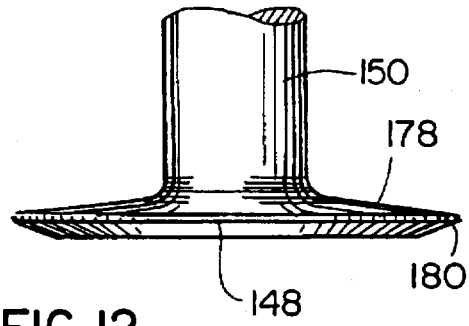
FIG. 12
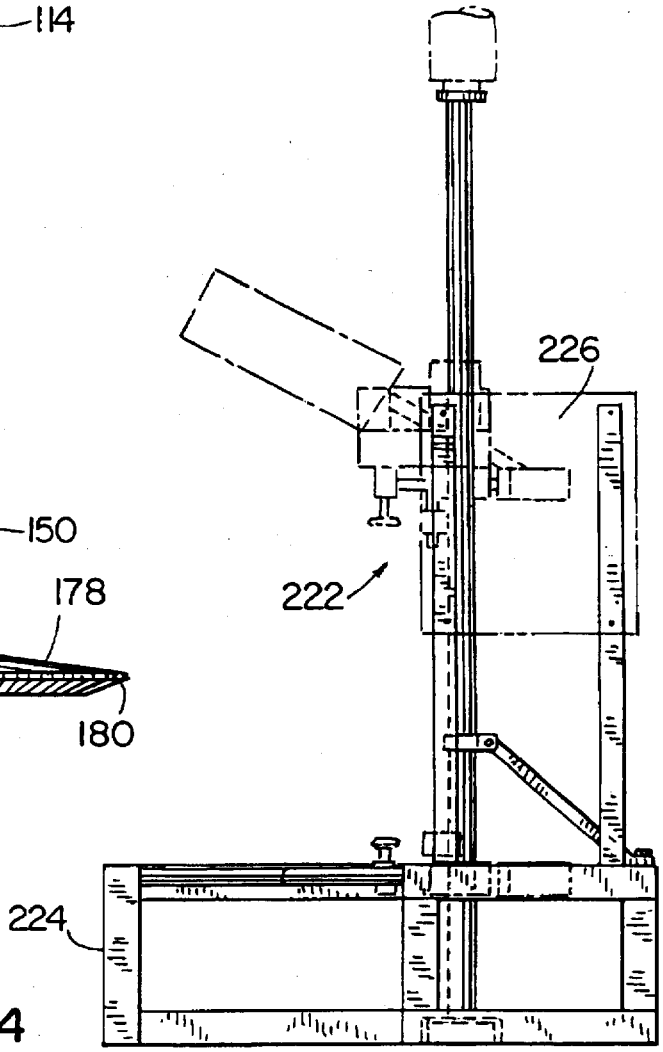
FIG. 14

FIBER DRUM CHIME REMOVING SYSTEM

BACKGROUND OF THE INVENTION

The invention relates to methods and apparatus for disassembling fiber or paperboard drums.

Fiber or paperboard drums typically come in 55 gallon and 30 gallon sizes, but can come in a variety of sizes. The drums have a cylindrical fiber sidewall and normally have a fiber bottom which is attached to the bottom edge of the fiber sidewall with a metal chime that is mounted continuously around the bottom edge. The bottom metal chime crimps the peripheral edge of the bottom to the lower edge of the fiber sidewall. The bottom metal chime extends up along the outer surface of the sidewall for about one or two inches. An upper metal chime is also mounted continuously around the upper edge of the fiber sidewall. The upper metal chime facilitates the use of clamps to clamp a top onto the drum.

Fiber drums are normally used as shipping containers which when emptied must be disposed of. It is becoming more expensive to dispose empty fiber drums in landfills, and some landfills have even been closed to fiber drums. Recycling the fiber or paperboard in the drums or incinerating the fiber or the paperboard, are often the only practical means for disposing of empty drums.

In order to dispose of the drums by incineration or recycling, the drums must be disassembled, and disassembly requires that the metal chimes be removed. Once the metal chimes are removed, the remaining fiber can be shredded, crushed and baled, or otherwise prepared for incineration, recycling or other means of efficient disposal. Many fiber drum users use substantial quantities of fiber drums, so automatic systems for removing metal chimes from fiber drums are desirable.

SUMMARY OF THE INVENTION

The invention is an automatic fiber drum chime removing system which can quickly remove metal chimes and disassemble fiber drums.

The invention provides a system having a movable cutting assembly that is mounted to a support structure in a manner that allows movement of the movable cutting assembly along the support structure in a longitudinal direction. It is preferred that the support structure be vertical so that the movable cutting assembly can be moved up and down in the vertical direction. The system preferably has a stationary cutting assembly also located along the support structure in the longtudinal direction. If the support structure is vertical, it is preferred that the stationary cutting assembly be located below the movable cutting assembly along the support structure. A fiber drum can be placed in the system, and the stationary and movable cutting assemblies can be positioned for cutting engagement to remove both the upper and lower chimes from the fiber drum contemporaneously.

In operation, a fiber drum is placed on a horizontal platform so that the bottom of the drum faces upward, and so that the upper drum chime is located in the stationary cutting assembly located at the base of the support structure. The movable cutting assembly is then moved downward in the vertical direction along the cutting assembly support structure until the movable cutting assembly is in cutting engagement with the lower drum chime. While there are many ways for automatically positioning the movable cutting assembly for cutting the lower drum chime, the preferred way uses a vertical position adjustment air cylinder to actuate a piston rod connected to the movable cutting assembly. A chime sensor, which is preferably a radial arm switch, can be used to sense the height of the lower drum chime so that the height of the movable cutting assembly can be positioned appropriately for cutting engagement.

Both the stationary and the movable cutting assemblies preferably have a rotatable drive wheel that can be positioned to engage an outside surface of the metal chime and a cutting wheel with a rotatable cutting head that can be disposed to engage the inside surface of the fiber sidewall opposite the drive wheel. The drive wheel engages against the outside surface of the chime and the cutting head engages against the inside surface of the fiber sidewall to cut the fiber sidewall. It is preferred that a piston rod actuated by a cutting wheel air cylinder provide automatic power for cutting engagement. Once the drive wheels and cutting heads for both the movable and the stationary cutting assemblies are in cutting engagement, the drive wheels are driven to rotate, and the fiber drum is rotated so that the cutting heads cut the sidewalls at the chimes around the drum. The upper metal chime being cut by the stationary cutting assembly can fall off naturally as long as the fiber sidewall is cut in a preferred location with respect to the upper metal chime. The lower chime which is cut by the movable cutting assembly normally includes attachment of the fiber bottom for the drum and cannot normally be cut so that the lower chime falls off automatically. Therefore, a chime cutter is provided on the movable cutting assembly to physically cut the lower chime and facilitate removal of the lower chime from the fiber drum. The chime cutter on the movable cutting assembly is preferably actuated by a knife air cylinder that is pivotally mounted to the movable cutting assembly. The chime cutter has a fixed blade that is fixed to the movable cutting assembly and a knife that is pivotally mounted to the fixed blade. The knife has a lever arm and a shearing blade. A piston rod connects the lever arm to the knife air cylinder to actuate the chime cutter.

In order to facilitate the cutting of the fiber sidewall around the lower metal chime when a fiber drum is being disassembled, it is preferred that the cutting wheel of the movable cutting assembly be tilted at about 5° downwards towards the cutting wheel so that the cutting head can more easily wedge into the lower chime/fiber bottom area of the drum.

Also, for both the movable and the stationary cutting assemblies, it is preferred to use a vertical knurled drive wheel having a generally horizontal circumferential groove. With such a drive wheel, the cutting heads should engage for cutting so that the cutting head is opposite the horizontal circumferential groove. In this manner, the chime is easily deformed during cutting, which facilitates cutting of the fiber sidewalls but the cutting head does not engage the teeth of the knurled drive wheel, which improves the life of the cutting head.

The invention also provides other features and advantages which will be apparent upon reading the following description of the drawings.

BRIEF DESCRIPTION OF THE DRAWINGS

FIG. 11 is a detailed sectional view of the chime cutter taken along line 11—11 in FIG. 5.

FIG. 12 is a detailed view of a cutting head used in the chime removing system.

FIG. 13 is a top view of an embodiment of the invention showing a protective frame.

FIG. 14 is a side elevational view of the embodiment of the invention having the protective frame as shown in FIG. 13.

DETAILED DESCRIPTION OF THE DRAWINGS

Figure 8:
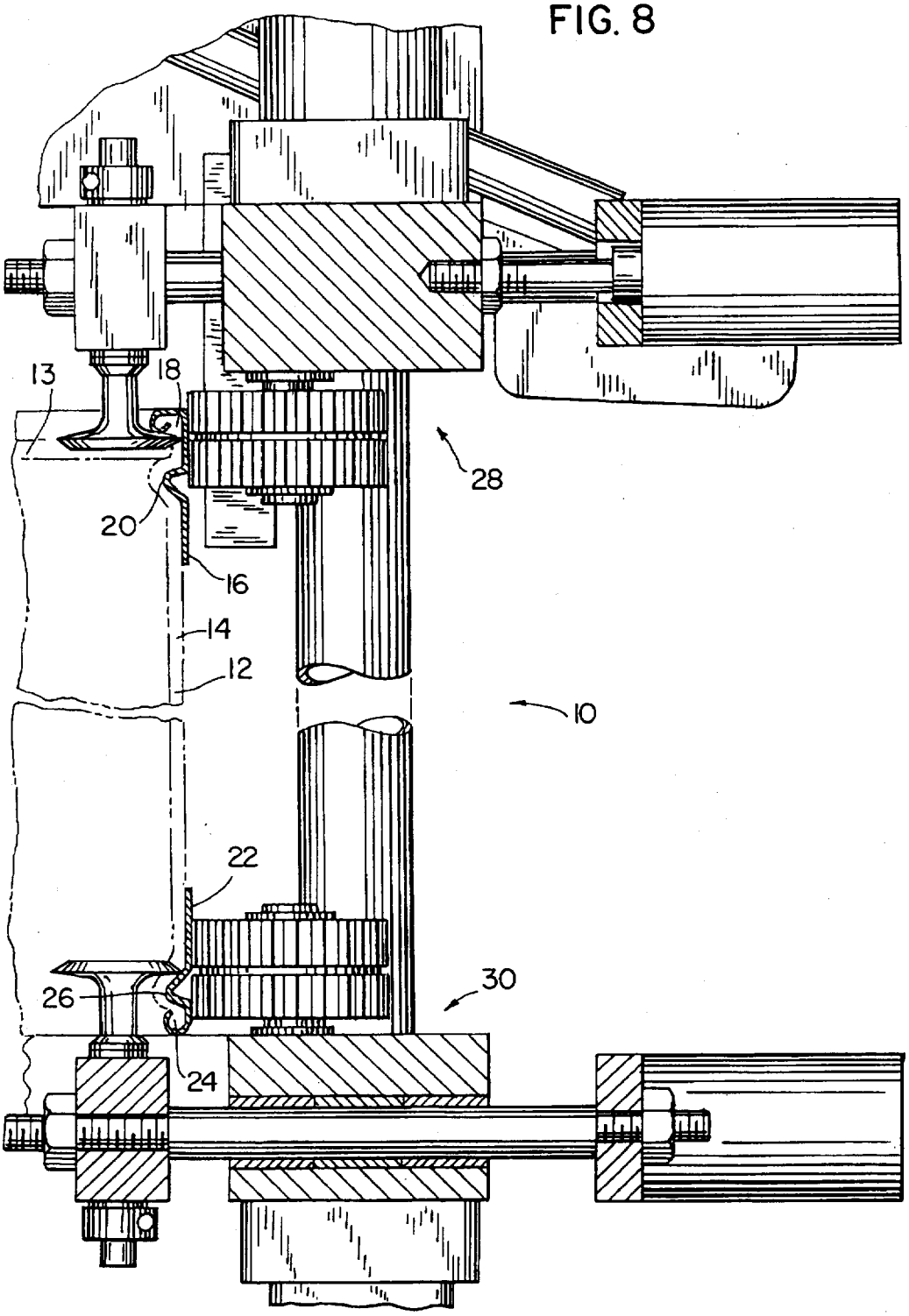
FIG. 8 is a side elevational view having parts broken away illustrating the operation of the movable and stationary cutting assemblies in the chime removing system of FIG. 1.

Referring first to FIG. 8, a fiber drum chime removing system 10 is used in accordance with the invention to disassemble a fiber drum 12. The fiber drum 12 is preferably placed in the chime removing system 10 with the drum bottom 13 facing upwards.

The drum 12 typically has a fiber or paperboard cylindrical sidewall 14, and also a fiber or paperboard bottom 13. A lower metal chime 16 attaches the fiber bottom 13 to a lower edge 18 of the fiber sidewall 14, and is mounted continuously around the lower edge 18 of the fiber sidewall 14. The lower metal chime 16 extends from the bottom of the drum along the outer surface of the fiber sidewall 14 for about an inch or two. The lower metal chime 16 includes a strength rib or crimp 20 that extends around the circumference of the drum 12. The drum 12 also has an upper metal chime 22 which is mounted continuously around an upper edge 24 of the fiber sidewall 14. The upper metal chime 22 extends from the upper edge 24 of the sidewall 14 along the outer surface of the fiber sidewall 14 for about an inch or two. The upper metal chime 22 also includes a strength rib or crimp 26 extending around the circumference of the drum 12. The fiber drum chime removing system 10 has a movable cutting assembly 28 for removing the lower metal chime 16 from the drum 12, and a stationary cutting assembly 30 for removing the upper metal chime 22 from the fiber drum 12.

Referring to FIGS. 1–4, the fiber drum 12 is placed in the system 10 on a platform 32 so that the upper metal chime 22 is located between a drive wheel 34 and a cutting wheel 36 for the stationary cutting assembly 30. The platform 32 has three generally horizontal spokes 38 which are connected in a center 40 of the platform 32. Such a three spoke support platform 32 is well-suited for accommodating fiber drums having various diameters as is shown best in FIG. 3. The platform 32 is integral with or part of a stand 42 for the entire chime removing system 10. The stand 42 has five legs 44 which support the platform 32 and the remainder of the system 10. Each of the legs 44 is mounted on an adjustable leveler 46.

A vertical cutting assembly support structure 48 extends upward from the stand 42. In the preferred embodiment, the vertical support structure 48 has two vertical support rods 50. Each of the vertical support rods 50 stands on a stand support bracket 52 which is connected horizontally across the stand 42 near the found behind the platform 32. A stationary cutting assembly support bracket 54 is horizontally mounted to the support rods 50 behind the platform 32. The stationary cutting assembly support bracket 54 is mounted to the stand 42 above the stand support bracket 52.

The stationary cutting assembly support bracket 54 has support rod holes 56 through which the vertical support rods 50 are placed. The holes 56 are generally circular holes having a slightly larger diameter than the vertical support rods 50. A slit 58 in the stationary cutting assembly support bracket 54 extends from each hole 56 to the peripheral edge of the bracket 54. A bolt 60 and a nut 62 tighten across each slit 58 to tighten the bracket 54 around the vertical support rods 50. A U-bracket 64 and a support bar 66 are connected to each vertical support rod 50 above the stationary cutting assembly support bracket 54. The end 68 of each support bar 66 opposite the U-bracket 64 is attached to the rear part of the stand 42 with a rod end, nut and bolt assembly 70. Each of the vertical support rods 50 of the cutting assembly support structure are thus fixed in a vertical position. Note that the support bar 66 used to support the vertical support rods 50 of the support structure are angled both inward and upwards as the bar 66 extends from the stand 42.

Figure 4:
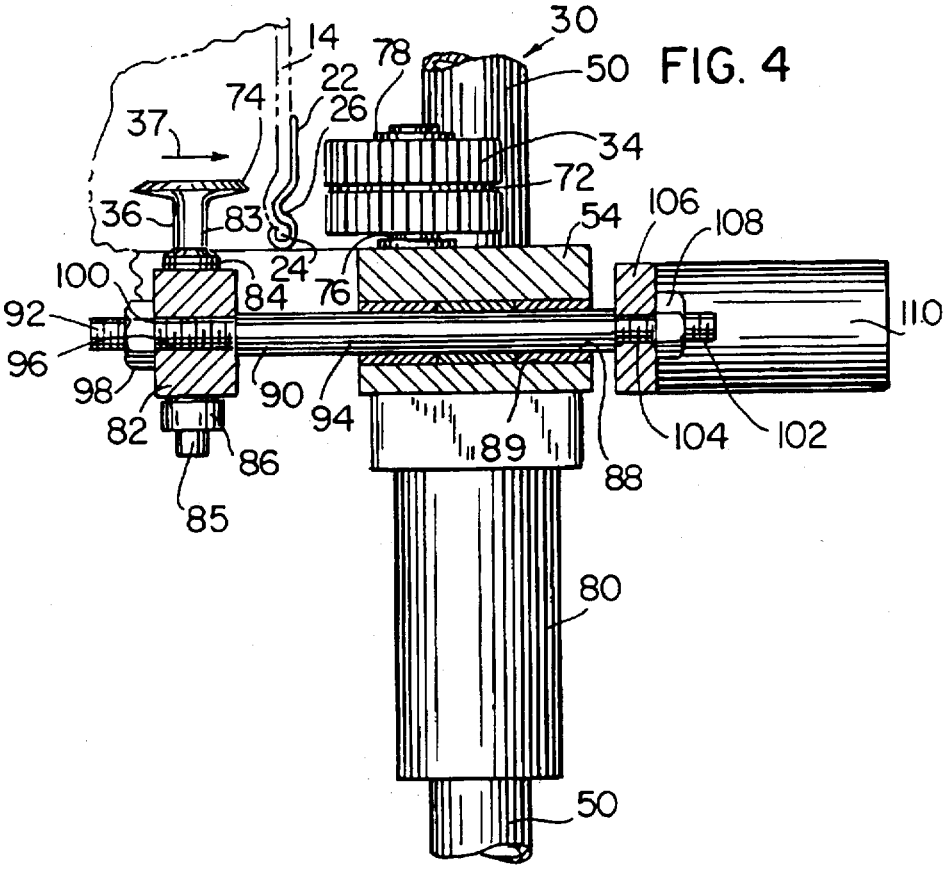
FIG. 4 is a sectional view of a part of the chime removing system taken along lines 4—4 in FIG. 3.

Referring in particular to FIG. 4, the stationary cutting assembly 30 includes a stationary drive wheel 34 and a stationary cutting wheel 36. Both the stationary drive wheel 34 and the stationary cutting wheel 36 rotate. The stationary cutting wheel 36 can also move in the horizontal direction in the direction of arrow 37 to cut the upper edge 24 of the fiber sidewall 14. The term "stationary" is used to indicate that the drive wheel 34 and the cutting wheel 36 do not move under normal operation in the vertical direction relative to the stand 42.

The stationary drive wheel 34 preferably has a knurled edge with vertical teeth. It is preferred that there be no more than ten teeth per inch around the knurl of the stationary drive wheel 34. The drive wheel 34 also preferably has a circumferential groove 72. The preferred circumferential groove 72 is ⅛ inch wide and 0.025 inch deep. The purpose of the groove 72 is to allow the chime 22 to be deformed when the cutting wheel 36 engages the drive wheel 34 for cutting, yet prevent the head 74 of the cutting wheel 36 from contacting the drive wheel 34. By not allowing the head 74 of the cutting wheel 36 to contact the drive wheel 34, the head 74 does not wear out prematurely.

The stationary drive wheel 34 is mounted to a drive shaft 76 using snap rings such as snap ring 78. The stationary cutting assembly support bracket 54 has a generally vertical drive shaft hole (not shown) in which the drive shaft 76 is rotatably mounted. The drive shaft 76 is preferably hollow, and receives an output shaft (not shown) from an electric motor 80 mounted to the stationary cutting assembly support bracket 54. A suitable electric motor 80 is a direct current electric motor having a ¼ horsepower and 42 RPM output. The mounting of the output shaft of the electric motor 80 through the stationary cutting assembly support bracket 54 into the drive shaft 76 is similar to the configuration shown in FIG. 7 for the movable cutting assembly 28.

The stationary cutting wheel 36 is rotatably mounted through a front housing 82. It is preferred that the stationary cutting wheel 36 be rotatably mounted through a generally vertical bearing hole (not shown) through the front housing 82. The cutting wheel 36 has a cutting head 74 and a cutter shaft 83 extending perpendicularly from the cutting head 74. The cutter shaft 83 is mounted in the front housing 82 so that the end 85 of the cutter shaft 83 opposite the cutting head 74 is exposed below the front housing 82. A stop 84 is located circumferentially around the cutter shaft 83 on the side of the cutter shaft 83 located above the front housing 82. The stop 84 prevents the cutter shaft 83 from sliding downward through the front housing 82 past the stop 84. A lockable collar 86 is screwed on to the exposed end 85 of the cutter shaft 83 to lock the cutting wheel 36 in the proper position so that the cutting head 74 is opposite the circumferential groove 72 in the drive wheel 34.

The stationary cutting assembly support bracket 54 has two horizontal guide shaft bearing holes 88. The guide shafts 90 are slidably mounted through the guide shaft bearing holes 88. The front end 92 of each guide shaft 90 is threaded and has a smaller diameter than the central portion 94 of the guide shaft 90. Each front end 92 extends through a hole 96 in the front housing 82. A nut 98 tightens the front housing 82 against a shoulder 100 formed between the central portion 94 and the front threaded portion 92 of each guide shaft 90. The rear end 102 of each guide shaft 90 is also threaded and has a smaller diameter than the central portion 94 of the guide shaft. Each rear portion 102 extends through a hole 104 in a rear housing 106. A nut 108 tightens the rear housing 106 against each guide shaft 90. The cutter wheel 36, the front housing 82, the guide shafts 90, and the rear housing 106 slide through the guide shaft bearing holes 89 as a single unit to move the cutting head 74 horizontally towards and away from the drive wheel 34.

Before a fiber drum 12 is placed on the platform 32, the cutting wheel 36 and the drive wheel 34 are spaced apart from one another to allow the drum upper chime 22 to be placed therebetween. An air cylinder 110 can be actuated to automatically pull the cutting wheel 36 towards the drive wheel 34 and engage the cutting head 74 to cut the upper end 24 of the fiber sidewall 14. The stationary cutting assembly air cylinder 110 is mounted to the rear side of the rear housing 106. The stationary cutting assembly air cylinder 110 is preferably a double acting air cylinder with a three inch inside diameter capable of providing 560 pounds of force at 80 psi. A piston rod 112 attached to the air cylinder 110 passes through the rear housing 106. The end of the piston rod 112 opposite the air cylinder 110 is screwed into the stationary cutting assembly support bracket 54 (not shown). The cutting head 74 is pulled towards the drive wheel 34 by actuating the air cylinder 110 to push the piston rod 112 against the stationary cutting assembly support bracket 54. As described in more detail below with respect to FIG. 7, the length of the piston rod 112 and the total axial displacement of the cutting head 74 are selected so that the cutting head 74 resides partially within the circumferential groove 72 of the drive wheel 34 when the cutting wheel 36 and the drive wheel 34 are in cutting engagement. Once the cutting wheel 36 and the drive wheel 34 for the stationary cutting assembly 30 are in cutting engagement, the motor 80 drives the drive wheel 34, and the cutting head 74 cuts the upper edge 24 of the fiber sidewall 14 as the drum 12 rotates.

Figure 16:
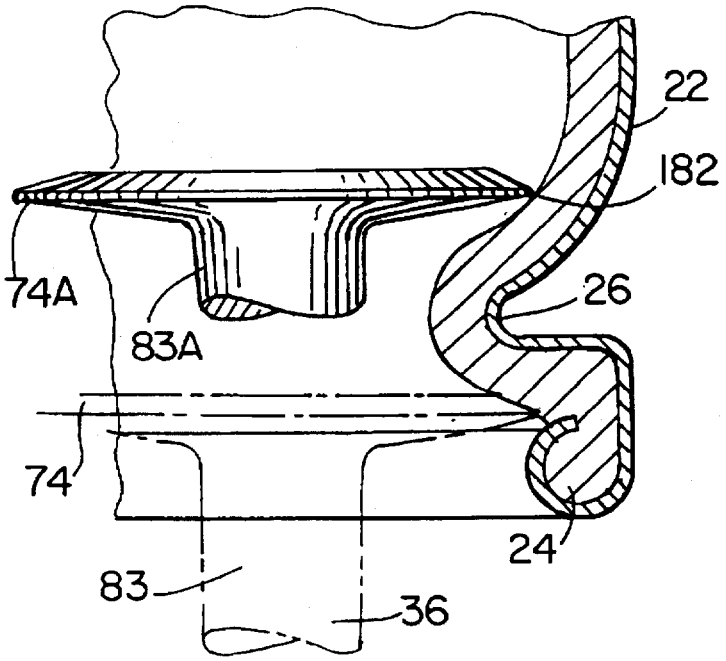
FIG. 16 is a detailed view showing a cutting head in position to cut an upper edge of a fiber drum sidewall to remove an upper metal chime from the fiber drum.

As shown best in FIG. 16, it may be preferred to cut the upper edge 24 of the fiber sidewall 14 at a point 182 beyond the strength rib or crimp 26. Cutting at point 182 can be desirable because the chime 22 will fall off easily if the cut is made beyond the strength rib 26. To make a cut at point 182, it may be necessary to use a cutting wheel having a cutting shaft 83*a* that is elongated between the stop 84 and the cutting head 74*a*.

Figure 5:
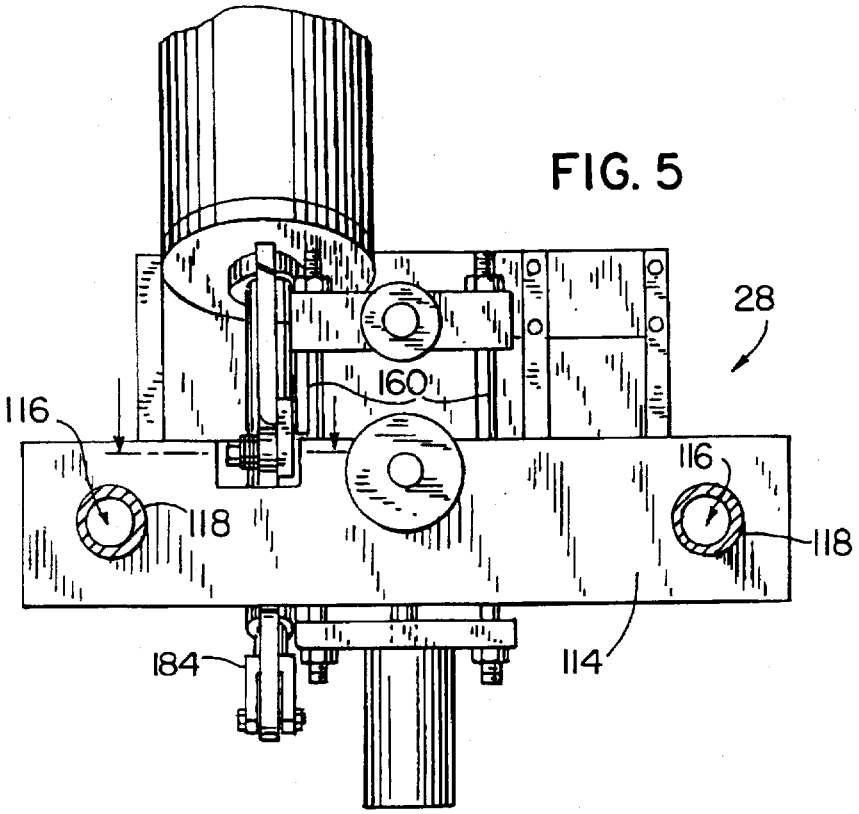
FIG. 5 is a horizontal view of the chime removing system taken along lines 5—5 in FIG. 1.
Figure 6:
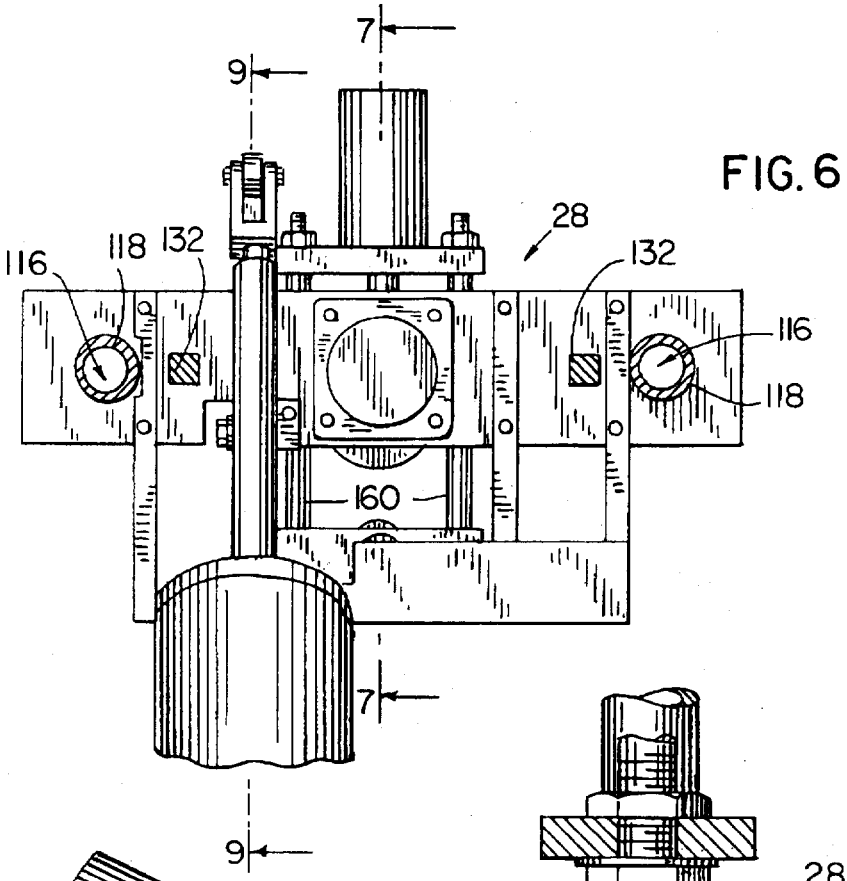
FIG. 6 is a top horizontal view of the chime removing system taken along lines 6—6 in FIG. 1.
Figure 7:
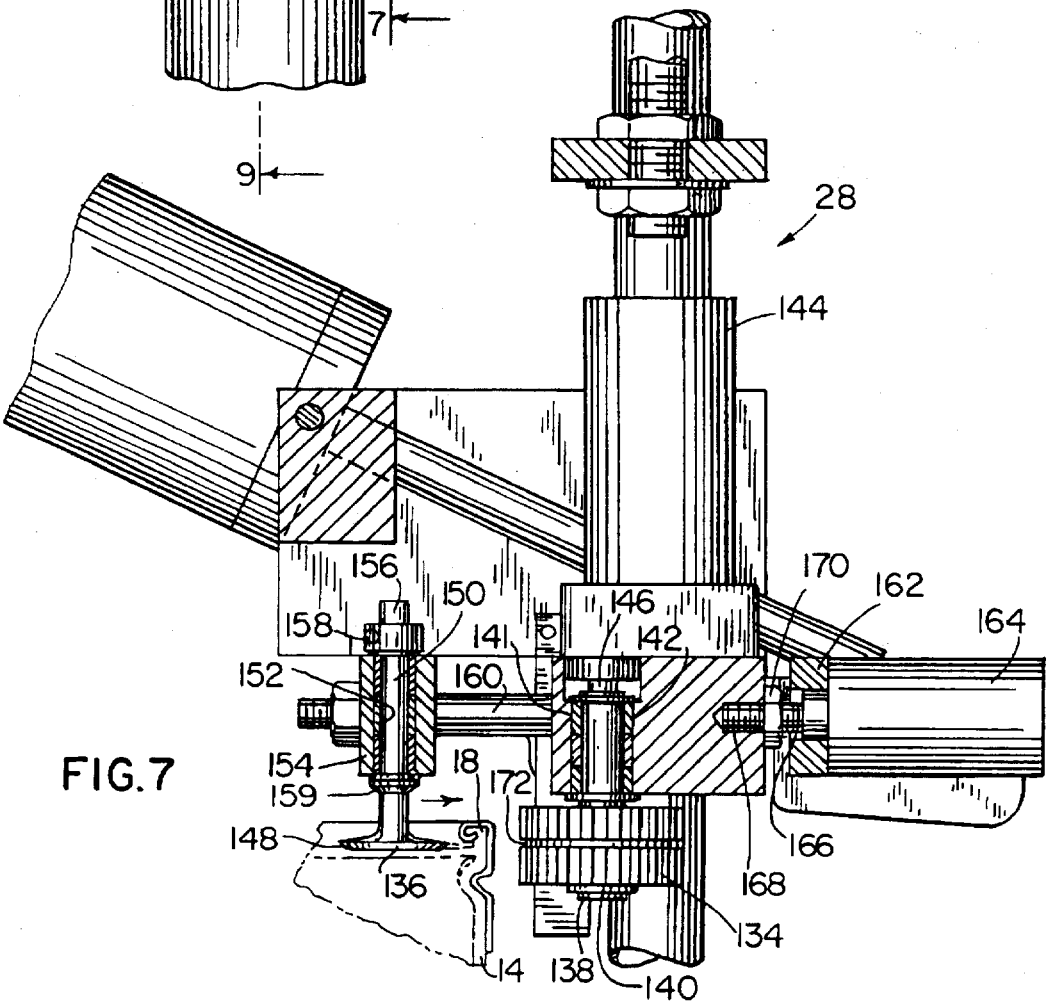
FIG. 7 is a sectional view of the chime removing system taken along lines 7—7 in FIG. 6.

FIGS. 5, 6 and 7 show the movable cutting assembly 28. A movable cutting assembly support bracket 114 has two vertical support rod bearing holes 116. Each vertical support rod bearing hole 116 has a bronze bearing 118 fixed therein. The bronze bearings 118 are slidably mounted over the cutting assembly support rods 50. The movable cutting assembly 28 slides up and down along the vertical support rods 50, and the bronze bearings 118 provide sufficient lubricity for extended wear.

Figure 1:
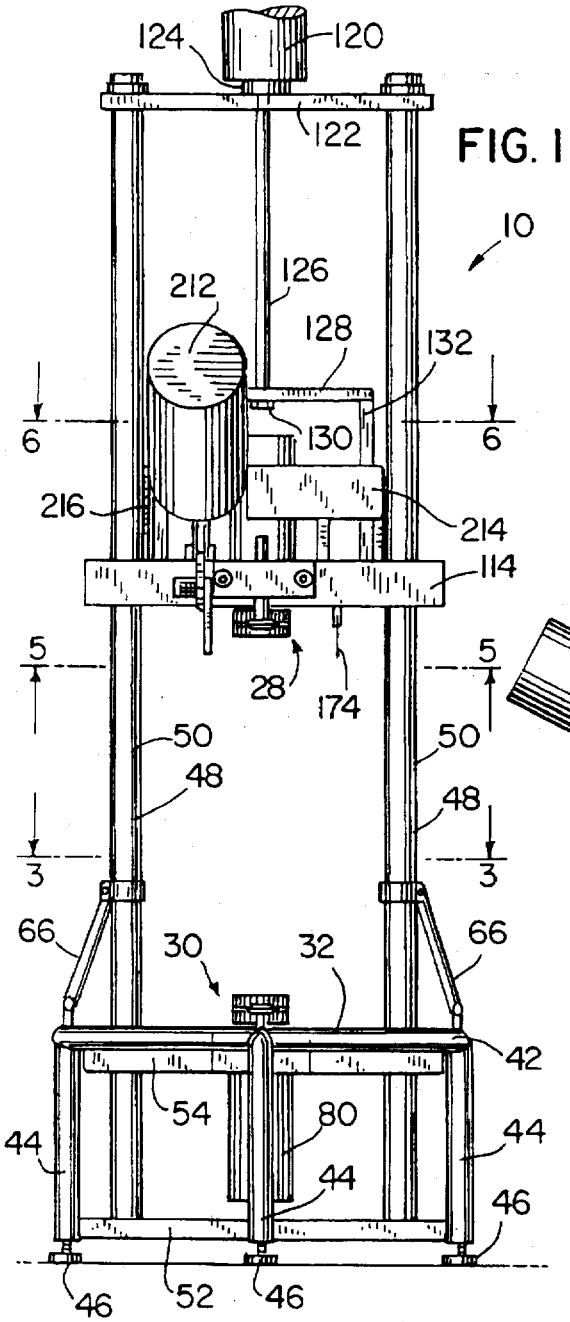
FIG. 1 is a front elevational view of a fiber drum chime removing system in accordance with the invention.
Figure 2:
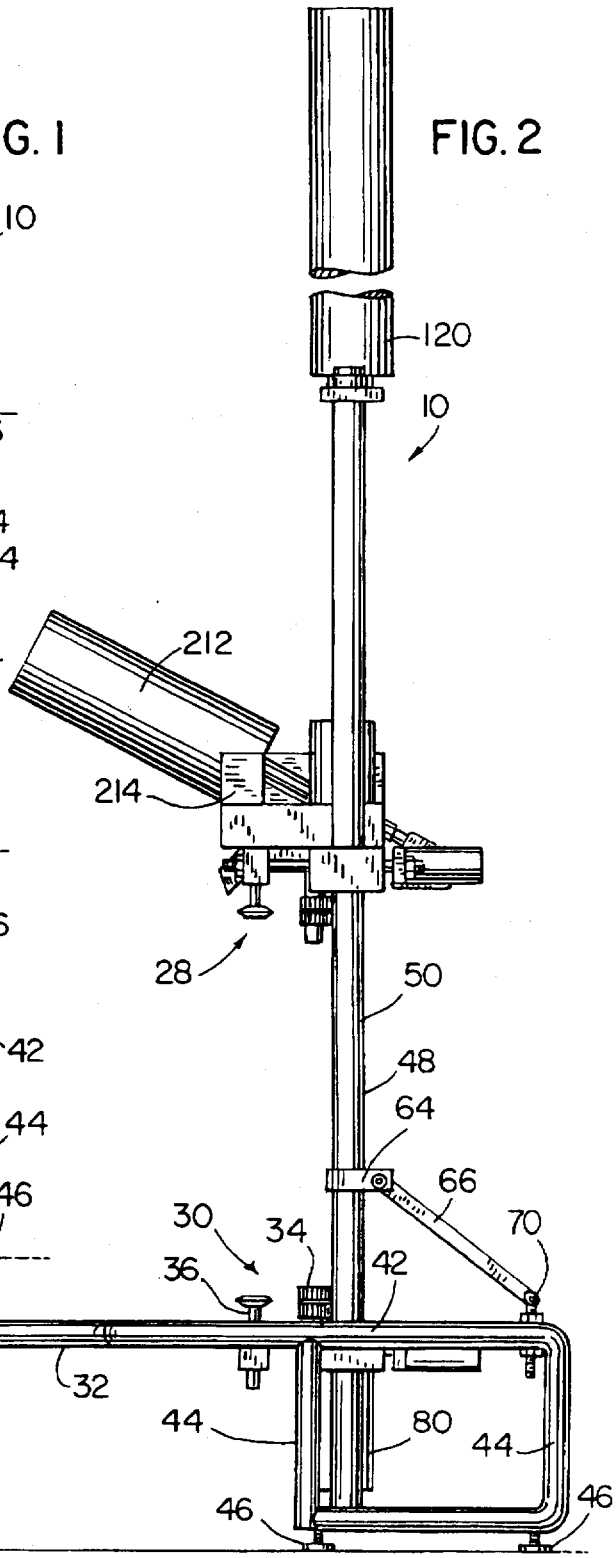
FIG. 2 is a side elevational view of the chime removing system shown in FIG. 1.
Figure 3:
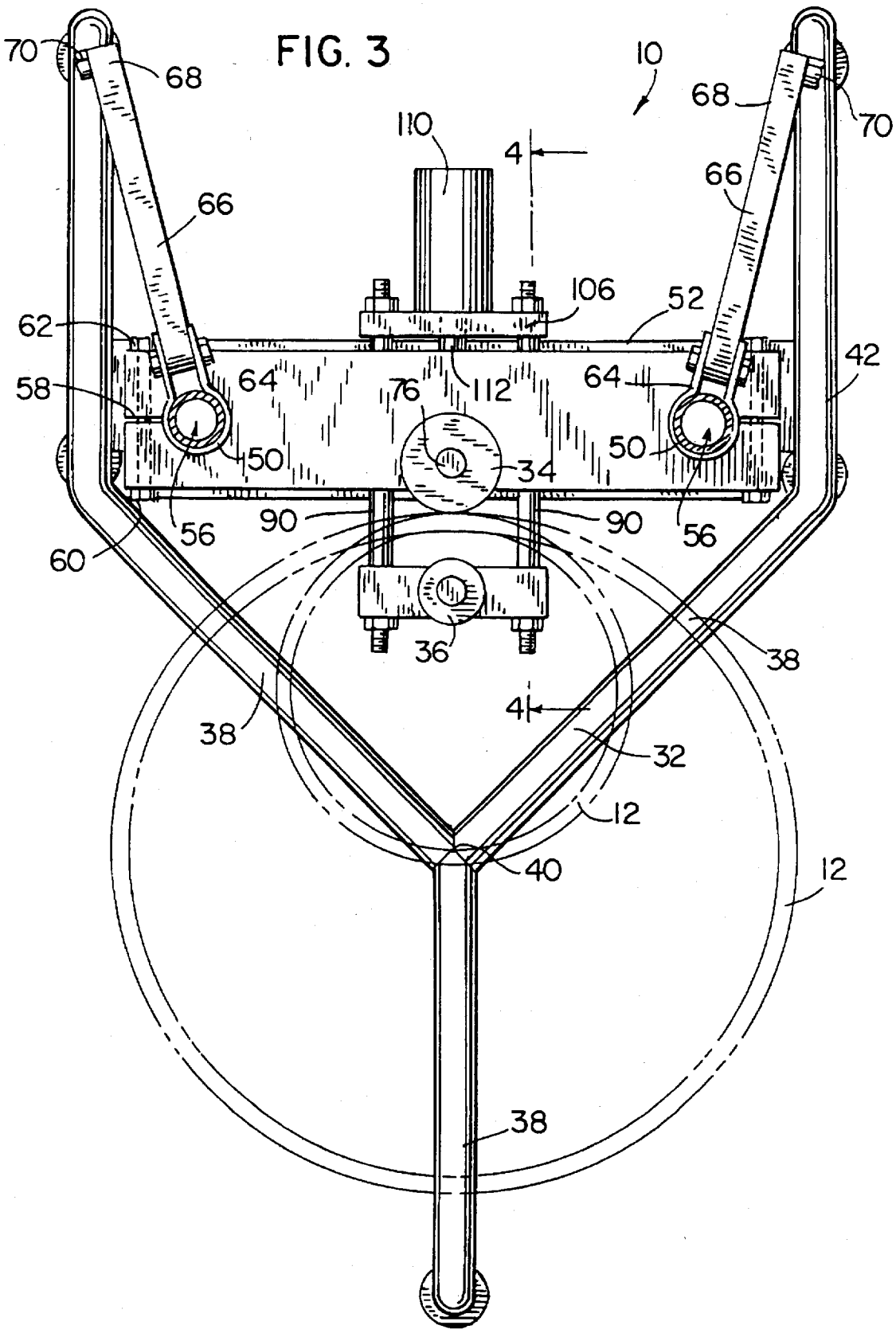
FIG. 3 is a top horizontal view of the chime removing system taken along lines 3—3 in FIG. 1.

Referring to FIGS. 1 and 2, a vertical position adjustment air cylinder 120 is mounted above the movable cutting assembly 28. The vertical position adjustment air cylinder 120 is mounted on a top support plate 122 which spans across the top portions of the vertical cutting assembly support rods 50. The top support plate 122 is preferably attached to the cutting assembly vertical support rod 50 in a similar manner as the stationary cutting assembly support bracket 54. The vertical position adjustment air cylinder 120 is preferably soft mounted to the top support plate 122 using a threaded collar 124. The soft mount allows the air cylinder 120 to move slightly with respect to the top support plate 122. The vertical position adjustment air cylinder 120 is preferably a double acting cylinder having a two inch inside diameter. A vertical position piston rod 126 is attached to the air cylinder 120 and is connected to the movable cutting assembly 28. Specifically, the vertical position adjustment piston rod 126 is connected to a connecting bracket 128 with a nut 130. The connecting bracket 128 is connected to connecting rods 132 which are connected to the movable cutting assembly support bracket 114. The vertical position adjustment air cylinder 120/piston rod 126 assembly moves the movable cutting assembly 28 up or down along the vertical cutting assembly support rods 50. The air cylinder 120 is preferably a 34 inch cylinder, which allows the movable cutting assembly 28 to be displaced along the vertical support rods 50 over a range of 34 inches. The 34 inch displacement range is useful to accommodate fiber drums 12 having varying heights.

Referring to FIGS. 5–7, the movable cutting assembly 28 has a drive wheel 134 and a cutting wheel 136. The drive wheel 134 and the cutting wheel 136 for the movable cutting assembly 28 are similar to the drive wheel 34 and the cutting wheel 36 for the stationary cutting assembly 30. The drive wheel 134 for the movable cutting assembly 28 is mounted to a hollow drive shaft 138 using snap rings such as snap ring 140. The movable cutting assembly support bracket 114 has a drive shaft bearing hole 141 that extends vertically through the bracket 114. A drive shaft bearing assembly 142 is located in the drive shaft bearing hole 141. An electric motor 144 is mounted to the top of the movable cutting assembly support bracket 114. The electric motor 144 is preferably similar to the electric motor 80 for the stationary cutting assembly 30. The electric motor 144 for the movable cutting assembly 28 has an output shaft 146 that is mounted in the hollow drive shaft 138. The output shaft 146 drives the drive shaft 138 to rotate the drive wheel 134.

The cutting wheel 136 for the movable cutting assembly 28 has a cutting head 148 and a perpendicularly extending cutter shaft 150. The cutter shaft 150 is rotatably mounted through a bearing hole 152 in a front housing 154. Although the bearing hole 152 through the front housing 154 can be vertical as shown in the drawings, it is preferable that the bearing hole 152 be slanted at a 5° angle so that the cutting head 148 slants downward at a 5° angle towards the drive wheel 134. A 5° downward slant for the cutting head 148 is especially useful when disassembling fiber drums 12 having a fiber bottom 13. The end 156 of the cutter shaft 150 that extends above the front housing 154 can be secured with a locking threaded collar 158, or a nut. The cutter shaft 150 for the movable cutting assembly 28 has a stop 159 for the same reason as the stop 84 of the cutting wheel 36 for the stationary cutting assembly 30.

Guide shafts 160 are mounted through the front housing 154 for the movable cutting assembly 28 in the same manner as the guide shafts 90 are mounted through the front housing 82 for the stationary cutting assembly 30. Also, the guide shafts 160 are slidably mounted through the movable cutting assembly support bracket 114 in the same manner as the guide shafts 90 are slidably mounted through the stationary cutting assembly support bracket 54. Likewise, the rear end of the guide shafts 160 for the movable cutting assembly 28 are mounted to a rear housing 162 in a similar manner as the rear ends of the guide shafts 90 are mounted to the rear housing 106 for the stationary cutting assembly 30. A movable cutting assembly air cylinder 164 is mounted to the rear housing 162. A piston rod 166 from the air cylinder 164 is secured to the movable cutting assembly support bracket 114. The end 168 of the piston rod 166 opposite the air cylinder 164 has threads which are screwed into a hole 168 in the movable cutting assembly support bracket 114. The depth of the piston rod 166 into the hole 168 can be adjusted by adjusting the depth of the threads of the piston rod 166 into the hole 168 and locking that position with locknut 170. The adjusting of the piston rod 166 depth provides fine tuning adjustment of the depth of the cutting head 148 into the circumferential groove 172 in the drive wheel 134. The same sort of fine tune adjustment for the depth of cutting engagement in the circumferential groove is also preferably carried out in the stationary cutting assembly 30.

In order to engage the cutting wheel 136 and the drive wheel 134 for cutting the lower edge 18 of the fiber sidewall 14, the movable cutting assembly air cylinder 164 is actuated to push the piston rod 166 against the movable cutting assembly support bracket 114. Once the drive wheel 134 and the cutting wheel 136 are in cutting engagement, the electric motor 144 drives the drive wheel 134 for the movable cutting assembly 28 and the fiber drum 12 rotates. It is preferred that the stationary cutting assembly 30 and the movable cutting assembly 28 both be in cutting engagement before the drive wheels 34 and 134 are driven to rotate. It is also preferred that once both cutting assemblies 28 and 30 are in cutting engagement that the drive wheels 134 and 34 be driven contemporaneously to remove the lower 22 and upper 16 chimes contemporaneously.

Figure 15:
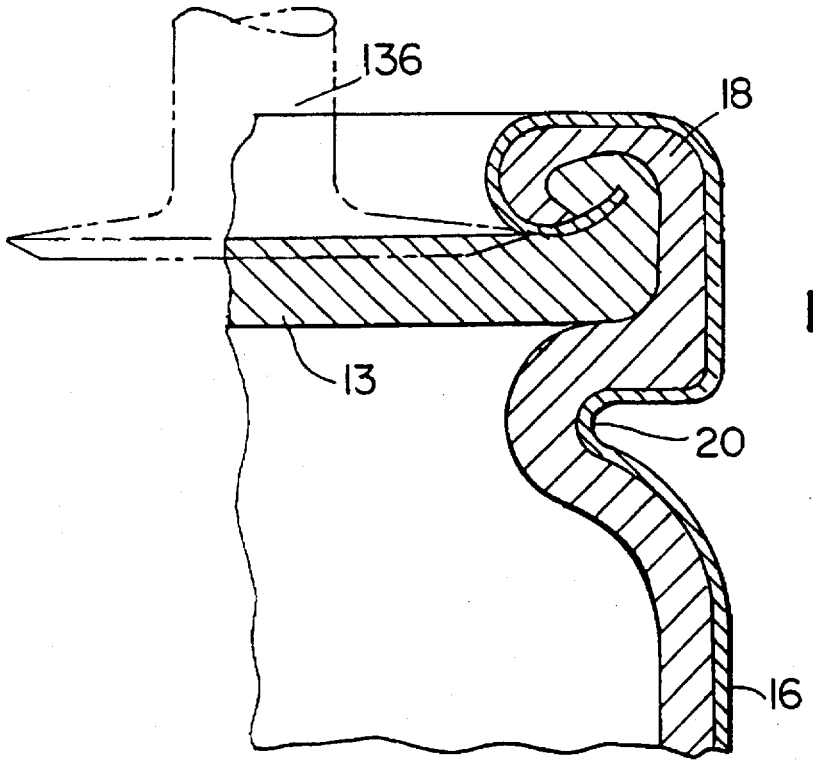
FIG. 15 is a detailed view showing a cutting head in position to cut a peripheral edge of a fiber drum bottom and a lower edge of the fiber drum sidewall to remove a lower metal chime from the fiber drum.

One advantage of the ability to move the movable cutting assembly 28 up and down along the vertical support structure 48 is that drums 12 can be easily placed in the system 10. Another advantage is that the system 10 can account for drums of varying heights. In operation, the movable cutting assembly 28 is located high above the normal position of the bottom 13 of a fiber drum placed on the platform 32. Once the drum 12 is placed on the platform 32, the user can hit a button and a system controller can instruct the vertical position adjustment air cylinder 120 to automatically lower the movable cutting assembly 28 along the cutting assembly support structure 48. A chime sensor 174 detects the position of the lower chime 16. The chime sensor 174 preferably outputs a signal to the system controller indicating the position of the lower chime 16, and the controller can then instruct the vertical position adjustment air cylinder 120 to stop further downward movement of the movable cutting assembly 28. The chime sensor 174 is preferably mounted to the movable cutting assembly support bracket 114. The preferred chime sensor 174 is a radial arm switch having an arm with a ⅛ inch diameter and an 8 inch length. The arm 176 preferably pivots at approximately the same height as the circumferential groove 172 of the drive wheel 134 for the movable cutting assembly 28, and preferably hangs at approximately a 45° angle downward. When arm 176 hits the bottom 13 of a fiber drum 12, the arm 176 is pushed upward. As arm 176 is being pushed upward, the switch is triggered and a signal is sent to the system controller. The system controller stops the downward descent of the movable cutting assembly 28 so that the drive wheel 134 and the cutting head 136 are properly positioned for cutting of the lower chime 16. As shown best in FIG. 15, after the downward descent of the movable cutting assembly 28 has been stopped, it is desirable that the cutting head 148 push down on the fiber bottom 13 of the drum 12 with an amount of force sufficient to keep the cutting head 136 at a proper cutting height while the lower edge 18 of the fiber sidewall 14 is being cut. To accomplish this, it is preferred that the vertical position adjustment air cylinder 120 provide a net positive downward force of 40 pounds. That is, if the movable cutting assembly 28 weighs 100 pounds, the vertical position adjustment air cylinder should provide an upward force via the piston rod 126 of 60 pounds.

Referring now to FIG. 12, it is preferred that the cutting head 136 have a slanted top surface 178 and a beveled lower surface 180. It is preferred that the top surface 178 slant at a 7° angle above the horizontal plane. It is preferred that the lower beveled surface 180 be beveled at a 19° angle below the horizontal plane. Note that the cutting wheel 136 for the movable cutting assembly 28 and the cutting wheel 36 for the stationary cutting assembly 30 are both preferably slanted and beveled in this manner. However, it should also be noted that it is preferred to slant the entire cutting head 148 of the movable cutting assembly 28 at 5° downward towards the drive wheel 134.

Since the movable cutting assembly 28 is normally cutting the lower end 18 of fiber sidewall 14 where the fiber bottom 13 is present, it is normally not practical to cut beyond the strength rib or crimp 20. Therefore, it is preferred that the system 10 include a chime cutter 184 for automatically cutting the lower metal chime 16 to facilitate the removal of chime 16 from the drum 12.

Figure 9:
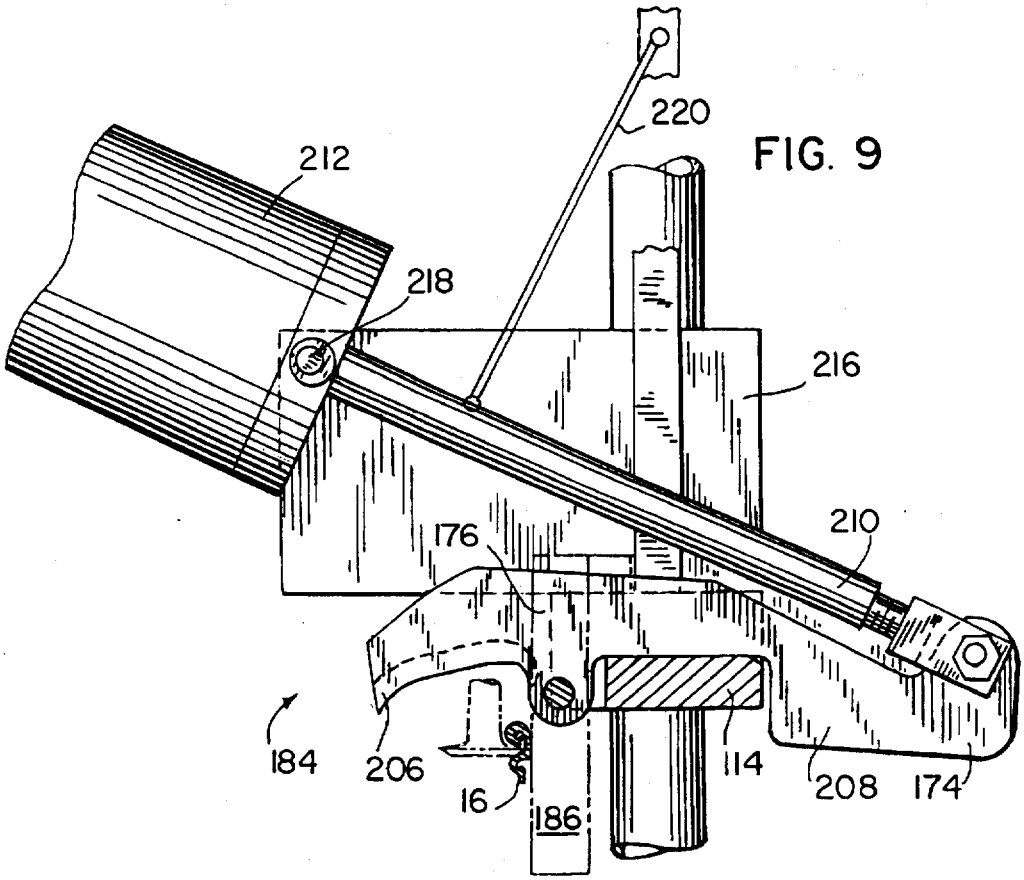
FIG. 9 is a sectional view of a part of the chime removing system taken along line 9—9 in FIG. 6.
Figure 10:
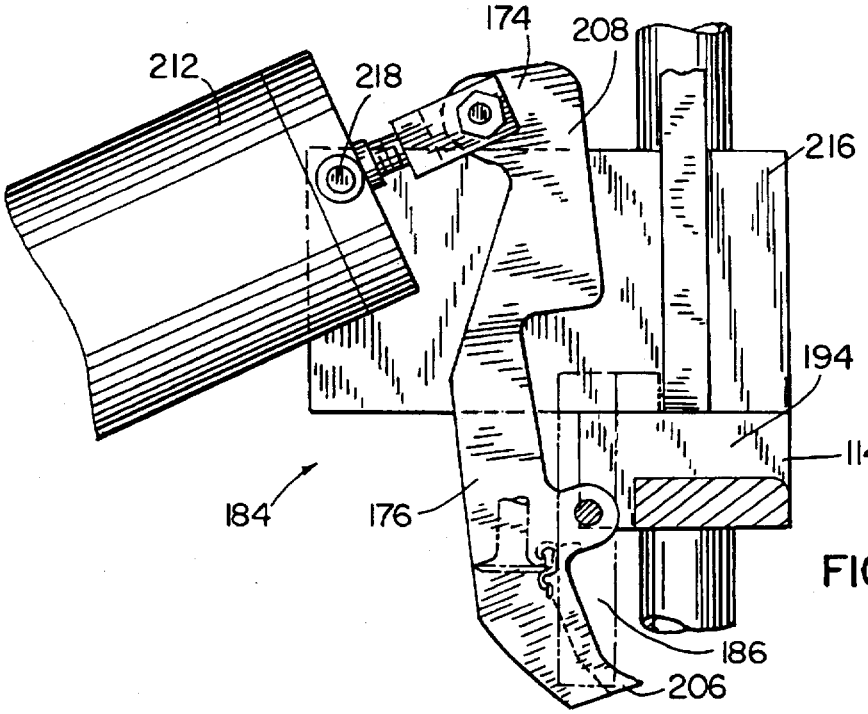
FIG. 10 is a view similar to FIG. 9 showing a chime cutter shearing blade in a closed position.

The chime cutter 184 can best be seen in FIGS. 9, 10 and 11. The chime cutter 184 has a fixed blade 186. That is, fixed relative to the movable cutting assembly support bracket 114. As shown in FIG. 11, the fixed blade 186 is attached to the movable cutting assembly support bracket 114 using a fixed blade support block 188 and screws. The support block 188 is attached to the movable cutting assembly support bracket 114 with screws 190, and the fixed blade is attached to the support block 188 with screws 192, 192A and 193. A cutting knife 194 is pivotally attached to the fixed blade 186. A shoulder bolt 198, a nut 200 and five washers 202 are used to pivotally attach the cutting knife 194 to the fixed blade 186. A notch 204 is cut out of the movable cutting assembly support bracket 114 to provide room for the fixed blade 186, the cutting knife 194, the shoulder bolt 198, the washers 202 and the bolt 200. The cutting knife 194 has a shearing blade 206 and a lever arm 208. The lever arm 208 is pivotally connected to a chime cutter piston rod 210 which is driven by a knife air cylinder 212. The knife air cylinder 212 is preferably a double acting cylinder having a 4 inch I.D., and being capable of providing 1000 pounds of force at 80 psi. The knife air cylinder 212 must provide sufficient force to cut the metal chime 16, as well as cut through the fiber bottom 13 and the fiber sidewall 14 of the drum 12. In order to accommodate the motion of the lever arm 208, the knife air cylinder 212 is pivotally mounted. A knife air cylinder support block 214 is mounted on top of the movable cutting assembly support bracket 114 and provides one location to which the knife air cylinder 212 is pivotally mounted. The knife air cylinder support block 214 is preferably a 2×4×8.6 inch block of aluminum. A knife air cylinder support plate 216 (see FIG. 1) is provided on the other side of the knife air cylinder 212 to provide another location for pivotally mounting the knife air cylinder 212. The knife air cylinder 212 can pivot about fulcrum 218 which is provided by support rods mounted through the knife air cylinder support plate 216 and support block 214, respectively.

Once upper edge 24 of the fiber sidewall 14 has been cut by the cutting wheel 36 for the stationary cutting assembly 30 and the lower edge 18 by the cutting wheel 136 for the movable cutting assembly 28, the system controller instructs the knife air cylinder 212 to retract the chime cutter piston rod 210. Retracting piston rod 210 rotates the cutting knife 194 so that the shearing blade 206 rotates downward past a cutting plane between the fixed blade 186 and the shearing blade 206 as shown in FIG. 10. A chime cutter switch 220 generates a signal when the shearing blade 206 has passed the cutting plane. The preferred chime cutter switch 220 is a radial arm switch attached to a connecting rod 132 of the movable cutting assembly 28 and having a radial arm that rides on the chime cutter piston 210.

FIGS. 13 and 14 show an embodiment of the invention that is especially well-suited for heavy industrial applications. The system 222 shown in FIGS. 13 and 14 has a protective frame 224 made of four inch square tubing. The protective frame 224 protects the system 222 from machinery such as forklifts in heavy industrial applications. Note that the heavy-duty frame 224 does not completely surround the system 222, but leaves suitable access to the platform 32. Note also that the three spoke style platform 38 allows access deep into the system 222 without obstruction. FIGS. 13 and 14 also show a control box 226 for system 222 mounted at approximately eye level to provide easy control by the user. The control box 226 would typically have user buttons for starting the system 222 as well as appropriate electronics for controlling the air cylinders and motors in the system.

It should be recognized that there could be many variations, modifications or equivalents to the invention as described, and these variations, modifications and equivalents should be considered to be within the scope of the appended claims.

We claim:

1. A fiber drum chime removing system for disassembling a fiber drum having a fiber sidewall with an upper edge and a lower edge, an upper metal chime mounted continuously around the upper edge of the sidewall and extending down an outer surface of the sidewall, and a lower metal chime continuously mounted around the lower edge of the sidewall and extending up the outer surface of the sidewall, the fiber drum chime removing system comprising:

a cutting assembly support structure; and a movable cutting assembly including a movable cutting assembly support bracket slidably mounted to the cutting assembly support structure to move relative to the cutting assembly support structure along a first linear, longitudinal axis, the movable cutting assembly further including a rotatable drive wheel rotatably mounted to the movable cutting assembly support bracket and having a linear position adjustable along the first linear, longitudinal axis to dispose the rotatable drive wheel for engagement with an outer surface of the lower metal chime by moving the movable cutting assembly along the cutting assembly support structure, a rotatable cutting wheel mounted to the movable cutting assembly support bracket and having a linear position adjustable along the first linear, longitudinal axis, the cutting wheel having a cutting head disposed to engage an inside surface of the fiber sidewall opposite the rotatable drive wheel, means for engaging the drive wheel against the outside surface of the lower chime and the cutting head against the inside surface of the fiber sidewall to cut the fiber sidewall, and means for driving the rotatable drive wheel and rotating the drum so that the cutting head cuts the sidewall around the drum.

2. A fiber drum chime removing system as recited in claim 1 further comprising:

a stationary cutting assembly, which is located along the cutting assembly support structure in the first linear, longitudinal axis, the stationary cutting assembly including a stationary drive wheel that is rotatable and is disposed to engage an outer surface of the upper chime, a stationary cutting wheel having a rotatable cutting head disposed to engage an inside surface of the fiber sidewall opposite the stationary drive wheel, means for engaging the stationary drive wheel against the outside surface of the upper chime and the stationary cutting head against the inside surface of the fiber sidewall opposite the stationary drive wheel to cut the fiber sidewall, and means for driving the stationary drive wheel contemporaneously with the drive wheel of the movable cutting assembly so that the fiber drum rotates and the stationary cutting head cuts the sidewall around the drum.

3. A fiber drum chime removing system as recited in claim 1 wherein the drive wheel is a knurled drive wheel having vertical teeth and the lower chime is deformed by the teeth of the drive wheel when the drive wheel and the cutting edge are in cutting engagement with each other, but the cutting head does not directly contact the drive wheel teeth.

4. A fiber drum chime removing system as recited in claim 1 wherein the drive wheel has a circumferential groove that is perpendicular to an axis of the drive wheel.

5. A fiber drum chime removing system as recited in claim 1 wherein the cutting head on the cutting wheel of the movable cutting assembly has a lower beveled surface and an upper slanted surface.

6. A fiber drum chime removing system as recited in claim 1 wherein the first linear, longitudinal axis along the cutting assembly support structure is vertical.

7. A fiber drum chime removing system as recited in claim 1 wherein the means for engaging the rotatable drive wheel of the movable cutting assembly against the outer surface of the lower chime and the cutting head of the movable cutting assembly against the inside surface of the fiber sidewall to cut the fiber sidewall comprise a piston rod actuated by a cutting wheel air cylinder.

8. A fiber drum chime removing system as recited in claim 7 wherein the piston rod is attached to the movable cutting assembly and the position of the cutting head relative to the drive wheel when the cutting head and the drive wheel are in cutting engagement is adjusted by adjusting the depth of attachment of the piston rod into the movable cutting assembly.

9. A fiber drum chime removing system as recited in claim 1 wherein the system further comprises a position adjustment piston rod actuated by a position adjustment air cylinder that moves the movable cutting assembly along the cutting assembly support structure and along the first linear, longitudinal axis to position the drive wheel and the cutting head of the movable cutting assembly for cutting engagement.

10. A fiber drum chime removing system as recited in claim 9 wherein the fiber drum also has a fiber bottom and the lower metal chime attaches the fiber bottom to the lower edge of the fiber drum, and the position adjustment piston rod maintains a net positive force by the cutting head of the movable cutting assembly against the fiber bottom when the drive wheel and the cutting head of the movable cutting assembly are in cutting engagement.

11. A fiber drum chime removing system as recited in claim 10 wherein the net positive force is about 40 pounds.

12. A fiber drum chime removing system for disassembling a fiber drum having a fiber sidewall with an upper edge and a lower edge, an upper metal chime mounted continuously around the upper edge of the sidewall and extending down an outer surface of the sidewall, and a lower metal chime continuously mounted around the lower edge of the sidewall and extending up the outer surface of the sidewall, the fiber drum chime removing system comprising:

a cutting assembly support structure;

a movable cutting assembly mounted to the cutting assembly support structure and being movable along the cutting assembly support structure along a first linear, longitudinal axis;

the movable cutting assembly including a chime cutter having a fixed blade that is fixed in position relative to the movable cutting assembly, a pivoting knife having a lever arm and a shearing blade, the pivoting knife being pivotally attached to the fixed blade, a knife air cylinder pivotally mounted to the movable cutting assembly, and a knife piston rod attached to the lever arm of the knife and actuated by the knife air cylinder.

13. A fiber drum chime removing system as recited in claim 12 wherein the movable cutting assembly further comprises:

a knife air cylinder support block to which the knife cylinder is pivotally mounted.

14. A fiber drum chime removing system as recited in claim 12 wherein the movable cutting assembly further comprises:

a movable cutting assembly support bracket that is mounted to the cutting assembly support structure and support the movable cutting assembly and to which the fixed blade and the shearing blade of the knife are mounted.

15. A fiber drum chime removing system as recited in claim 12 further comprising:

a knife sensor that senses when the shearing blade on the knife is passed a cutting plane between the knife shearing blade and the fixed blade of the chime cutter.

16. A fiber drum chime removing system as recited in claim 15 wherein the knife sensor is a radial arm switch in which the radial arm rides on the piston rod attached to the lever arm of the knife.

17. A fiber drum chime removing system for disassembling a fiber drum having a fiber sidewall with an upper edge and a lower edge, an upper metal chime mounted continuously around the upper edge of the sidewall and extending down an outer surface of the sidewall, and a lower metal chime continuously mounted around the lower edge of the sidewall and extending up the outer surface of the sidewall, the fiber drum chime removing system comprising:

a cutting assembly support structure; and a movable cutting assembly including a movable cutting assembly support bracket mounted to the cutting assembly support structure and being movable along the cutting assembly support structure along a first linear, longitudinal axis, the movable cutting assembly including a rotatable drive wheel having a position adjustable along the first linear, longitudinal axis to dispose the rotatable drive wheel for engagement with an outer surface of the lower metal chime by moving the movable cutting assembly along the cutting assembly support structure, a rotatable cutting wheel having a cutting head disposed to engage an inside surface of the fiber sidewall opposite the rotatable drive wheel of the movable cutting assembly, means for enraging the drive wheel against the outside surface of the lower chime and the cutting head against the inside surface of the fiber sidewall to cut the fiber sidewall, means for driving the rotatable drive wheel and rotating the drum so that the cutting head cuts the sidewall around the drum;

means for moving the movable cutting assembly along the cutting assembly support structure to position the drive wheel and cutting head of the movable cutting assembly for cutting engagement; and a chime sensor that senses the position of the lower chime so that the movable cutting assembly can be properly positioned along the first linear, longitudinal axis for cutting engagement.

18. A fiber drum chime removing system as recited in claim 17 wherein the chime is a radial arm switch attached to the movable cutting assembly.

19. A fiber drum chime removing system for disassembling a fiber drum having a fiber sidewall with an upper edge and a lower edge, an upper metal chime mounted continuously around the upper edge of the sidewall and extending down an outer surface of the sidewall, and a lower metal chime continuously mounted around the lower edge of the sidewall and extending up the outer surface of the sidewall, the fiber drum chime removing system comprising:

a stand having a drum platform for placing a fiber drum such that the upper metal chime of the fiber drum lays on the drum platform with the fiber drum sidewall and the lower metal chime disposed thereabove;

a vertical cutting assembly support structure extending upwards from the stand;

a stationary cutting assembly which is located at a base of the vertical cutting assembly support structure and positioned to engage the upper metal chime of the fiber drum; and a movable cutting assembly slidably mounted to the vertical cutting assembly support structure above the stationary cutting assembly in a vertical direction to move along the vertical cutting assembly support structure in the vertical direction;

wherein the movable cutting assembly slides in the vertical direction along the vertical cutting assembly support structure to engage the lower metal chime of the drum at the same time the stationary cutting assembly is positioned to engage the upper metal chime of the drum.

20. A fiber drum chime removing system as recited in claim 19 wherein the stand has a drum platform that comprises three generally horizontal spokes connected in the middle of the platform.

* * * * *

UNITED STATES PATENT AND TRADEMARK OFFICE

CERTIFICATE OF CORRECTION

PATENT NO. : 5,682,681

DATED : November 4, 1997

INVENTOR(S) : Cincotta et al.

It is certified that error appears in the above-indentified patent and that said Letters Patent is hereby corrected as shown below:

CLAIM 18, Col. 12, Line 31, after "chime" insert ---sensor---; CLAIM 17, Col. 12, Line 15, delete "enraging" and insert ---engaging---;

Signed and Sealed this

Thirteenth Day of January, 1998

Bruce Lehman

*Attest:*

BRUCE LEHMAN

*Attesting Officer*

*Commissioner of Patents and Trademarks*